US005353465A

United States Patent [19]

Pierce et al.

[11] Patent Number: 5,353,465

[45] Date of Patent: Oct. 11, 1994

[54] SCRAPER APPARATUS

[76] Inventors: Webster Pierce, 233 W. 58th St.; Mack Cheramie, 2415 E. Main, both of Cut Off, La. 70345

[21] Appl. No.: 954,493

[22] Filed: Sep. 30, 1992

[51] Int. Cl.[5] ..... A47L 11/12

[52] U.S. Cl. ..... 15/236.01; 15/93.1; 30/272.1; 299/37; 173/170

[58] Field of Search ..... 15/93.1, 236.01; 30/169, 272.1, 277; 299/37, 38, 69; 173/170, 29; 248/206.5, 324, 537, 58

[56] References Cited

U.S. PATENT DOCUMENTS

| | | | |
|---|---|---|---|
| 895,349 | 8/1908 | Donohoe | 173/132 |
| 974,000 | 10/1910 | Towne et al. | 114/222 |
| 1,322,572 | 11/1919 | Hunter | 173/132 |
| 2,332,843 | 10/1943 | Christopherson | 114/222 |
| 2,831,451 | 4/1958 | May | 114/222 |
| 3,040,711 | 6/1962 | Townshend, Jr. | 173/132 |
| 3,712,390 | 1/1973 | Berg | 173/132 |
| 4,030,553 | 6/1977 | Rockwell | 173/1 |

*Primary Examiner*—Timothy F. Simone
*Assistant Examiner*—Reginald L. Alexander
*Attorney, Agent, or Firm*—Pravel, Hewitt, Kimball & Krieger

[57] ABSTRACT

A scraper apparatus, having a principal elongated housing; a handle member attached to a first end of the housing; a blade extending from the second end of the housing; a rod within the housing upon which the blade is mounted; a pneumatic power source for powering reciprocating movement of the rod means to impart reciprocating movement of the scraping blade; and a spring interconnecting the power source and the reciprocating rod to provide the reciprocating motion of the rod when power is applied thereto. The apparatus further comprises a support member along the length of the housing to magnetically secure the housing to a surface so that the weight of the apparatus is supported by the support member.

17 Claims, 3 Drawing Sheets

SCRAPER APPARATUS

BACKGROUND OF THE INVENTION

1. Field of the Invention

The apparatus of the present invention relates to scrapers. More particularly, the present invention relates to an improved scraper having a powered, reciprocating scraping blade, and including a support member to provide easy maneuverability of the scraper during use, which could be utilized, for example, to scrap barnacles off of ship hulls.

2. General Background

In general, many solid deposits which result on surfaces exposed to the weather, such as peeling paint, or solid deposits on metal, such as the interiors of tank cars, require manual scraping in order to remove the deposit from the surface. In general, there are numerous types of hand-held, manually operated scrapers, which, through tedious and tiresome work, get the scraping job accomplished. Some tasks which require scraping, however, are too vast and difficult to undertake manually, and if done manually, takes numerous man hours and an enormous amount of time.

One such time-consuming and difficult task, for example, occurs in the maritime industry. In the maintenance of sea vessels, such as boats or ships, one of the most demanding maintenance procedures is the procedure for scraping barnacles off of the hull of the vessel when it is placed in dry dock. After continued and long-term use of the vessel in sea water, barnacles become attached to the hull of the vessel, and the removal of the barnacles is a critical factor in returning the vessel to seaworthiness, to protect the integrity of the exterior hull surface. Therefore, many man hours of difficult work is undertaken in manually chipping the barnacles off of the vessel hull. In the present state of the art, this work is difficult and very time-consuming. What is needed is a system for scraping, for example, maritime vessel hulls, which would reduce the manual work of the scraping task, and at the same time, increase the production time in completing the task.

Several patents were found as a result of a patentability search conducted in the art. These patents are referenced in the art statement submitted herewith and incorporated herein by reference thereto. Other objects of the invention will be obvious to those skilled in the art from the following description of the invention.

SUMMARY OF THE INVENTION

The apparatus of the present invention solves the problems in the art in a simple and straightforward manner. What is provided is a scraper apparatus, having a principal elongated housing; a handle member attached to a first end of the housing; a blade extending from the second end of the housing; a rod within the housing upon which the blade is mounted; a pneumatic power source for powering reciprocating movement of the rod means to impart reciprocating movement of the scraping blade; and a spring interconnecting the power source and the reciprocating rod to provide the reciprocating motion of the rod when power is applied thereto. The apparatus further comprises a support member along the length of the housing to magnetically secure the housing to a surface so that the weight of the apparatus is supported by the support member.

Therefore, it is a principal object of the present invention to provide a scraper apparatus, pneumatically powered, which scrapes a surface through reciprocating movement of a blade;

It is a further object of the present invention to provide a scraper which when used on a metal surface, which may include a magnetically secured support member to help distribute the weight of the scraper;

It is a further object of the present invention to provide a pneumatically driven reciprocating scraper which is easy to use, requires less manpower, and allows easy maneuverability during the scraping process;

It is a further object of the present invention to provide a power driven scraper apparatus which is particularly adaptable to scraping large metal surfaces, through a powered reciprocating blade that can be interchanged, and a support member for distributing the overall weight of the scraper during use; and It is a further object of the present invention to provide a strap member secured to the apparatus for helping to support the apparatus on the shoulder of the operator during use.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figures 1, 5, 6:
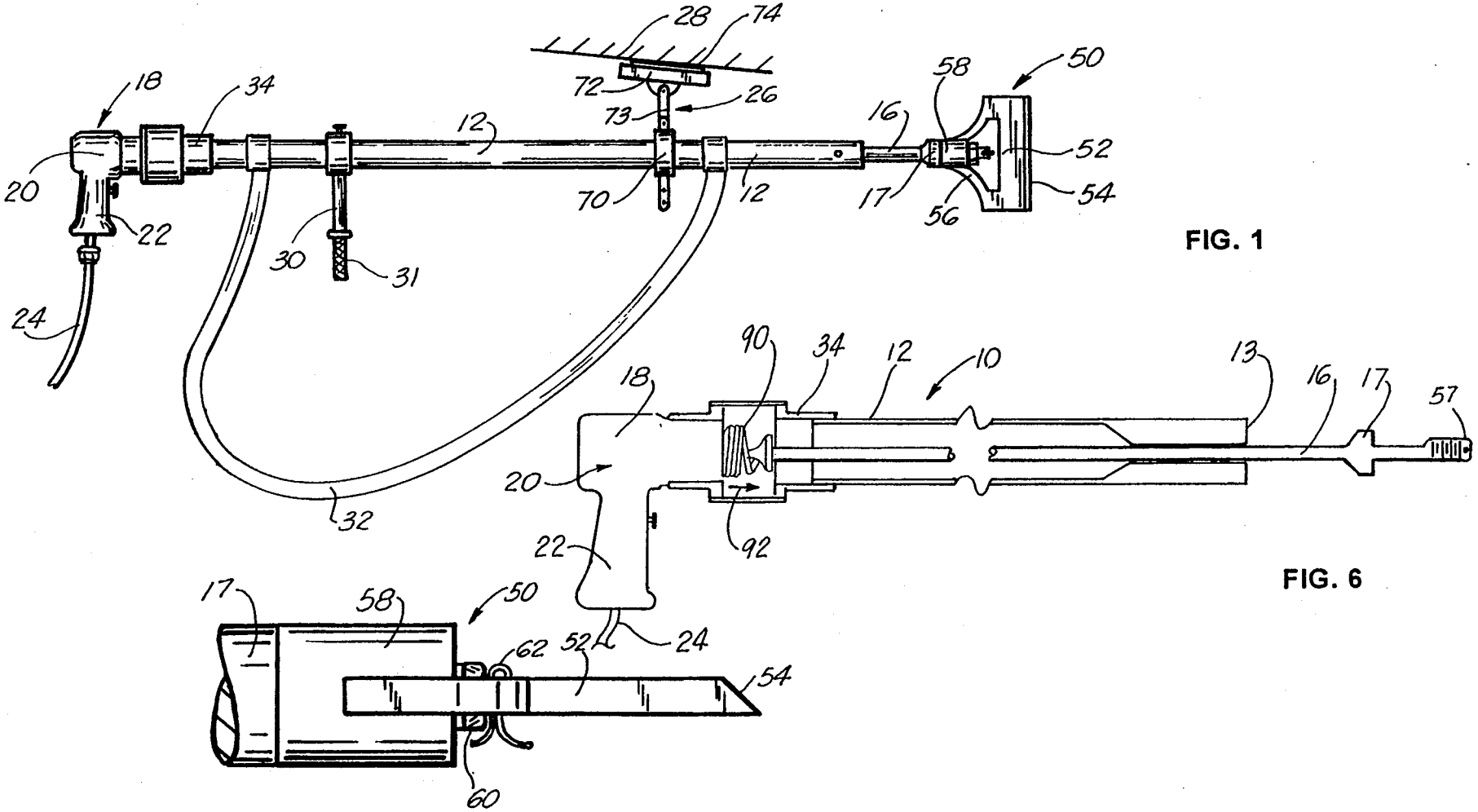
FIG. 1 illustrates an overall view of the preferred embodiment of the apparatus of the present invention.
FIGS. 4 and 5 illustrate top and side views respectively of a typical blade assembly used in the preferred embodiment of the apparatus of the present invention.
FIG. 6 illustrates an overall cutaway view of an alternate embodiment of the drive assembly of the present invention.

The preferred embodiment of the present invention is illustrated in FIGS. 1 through 5 by the numeral 10. As illustrated in overall view in FIG. 1, scraper 10 comprises generally an elongated housing 12, having a continuous bore 14 therethrough for housing a reciprocating drive shaft 16 during operation of the apparatus. Housing 12 would be actually a protective housing, which would serve to protect the mechanical components within the housing from debris or the like which would fall during the scrapping motion, and would protect the user from the internal components in the housing, should there be a mechanical failure within the housing during use. Further, the housing 12 is secured to a first hand-held handle member 18 on its second end, the handle member including a body portion 20 securing the elongated housing 12 thereto, and a handgrip portion 22, for grasping the apparatus during use. Further, there could be provided a shoulder strap 32 positioned at each end of the barrel 16 to assist the operator in holding the apparatus. As seen further in FIG. 1, there is provide a source of power, through line 24, which in the preferred embodiment would be pressurized air, for driving the drive shaft 16. Also, as illustrated, there is provided a magnetic support member 26, mounted along the housing 12, for engaging a metal surface 28 to help distribute the weight of the apparatus, and a second handle member 30 secured to the housing to hold the apparatus.

Figure 2:
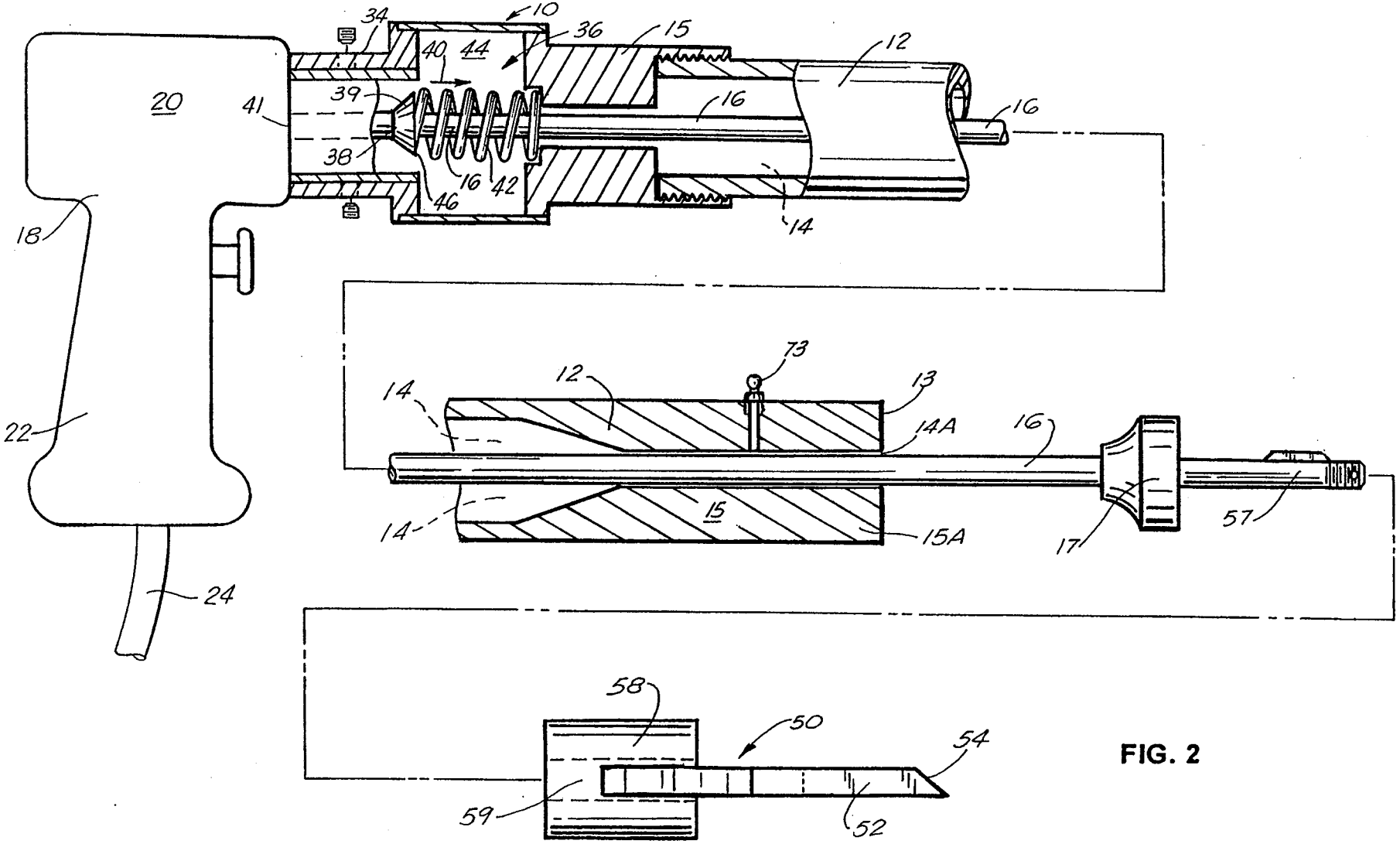
FIG. 2 illustrates an overall exploded cutaway view of the preferred embodiment of the apparatus of the present invention with the drive assembly, in the extended position.
Figure 3:
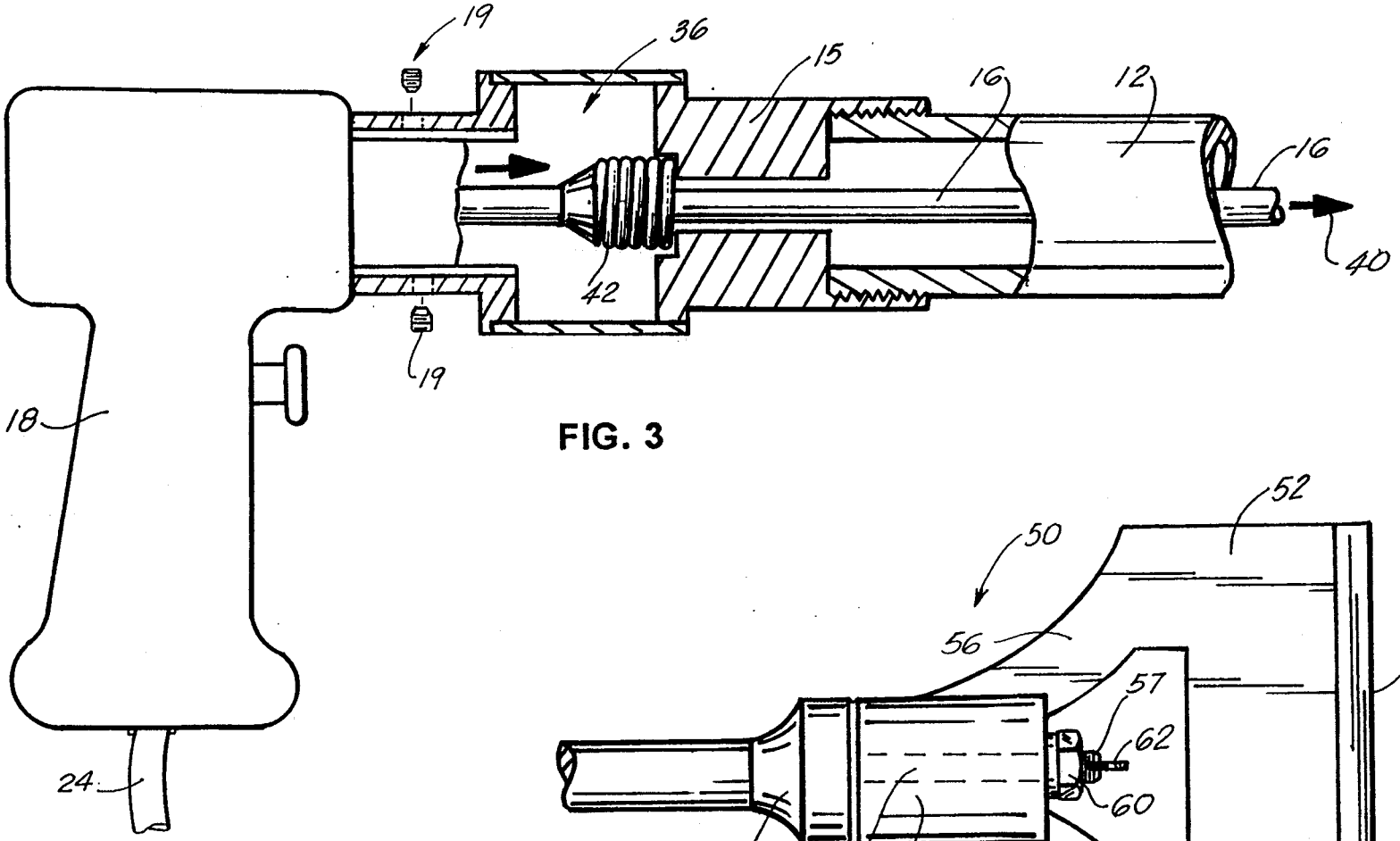
FIG. 3 illustrates an overall exploded cutaway view of the preferred embodiment of the apparatus of the present invention with the drive assembly in the retracted position.

Turning now to the specific structural components which comprise the apparatus, reference is made to FIG. 2 which is an exploded cutaway view of the preferred embodiment of the apparatus 10. As seen in FIG. 2, as described earlier, there is seen the handle member 18, to which there is secured an outer collar 34, which would interconnect the handle member 18 and the housing 12, which would include the apparatus drive assembly, through the use of several allen screws 19 as seen in FIG. 3. In general, the drive assembly 36 would comprise a first drive component 38, which would, upon introduction of pressurized air from the air source, through air line 24, would move the drive component in the direction of arrow 40. This component would be part of the drive shaft 16, which would continue through the length of housing 12. As seen in the figures, there would be provided a spring means 42, positioned within a chamber 44 formed by the collar member 34, with the first end of the spring abutting against an enlarged flared portion 39 of the shaft 16 at point 46, and the second end secured against the housing body 15 as seen in FIG. 2. In this position, the spring is fully extended, with no air being introduced into the system.

Figure 4:
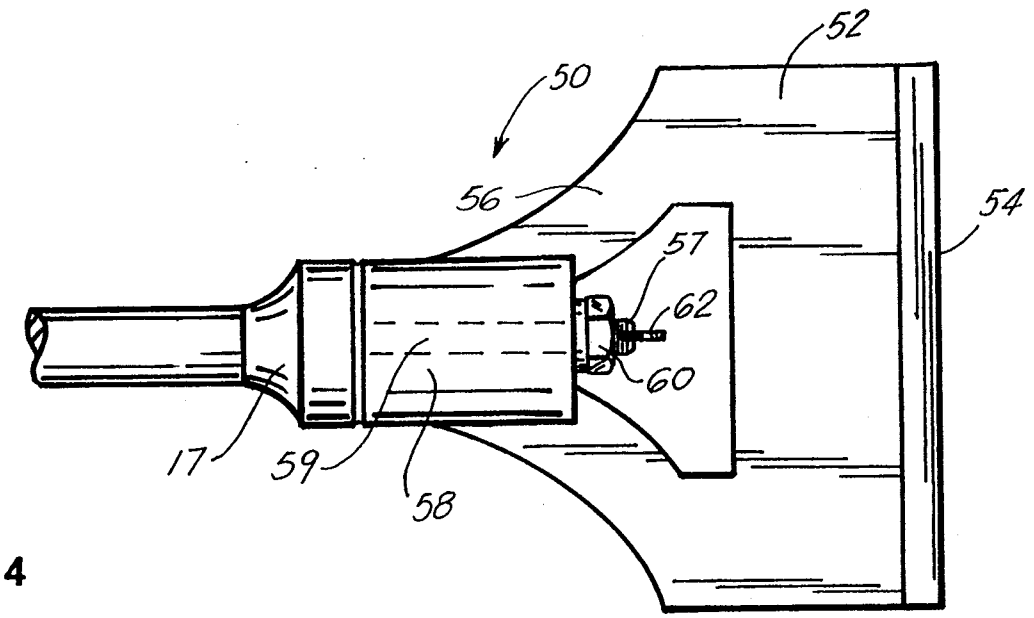

As seen, the shaft 16 extends through housing 12 and terminates by extending out of the distal end 13 of housing 12, to which there is positioned a circular mounting stop 17 for securing a scraping blade 50 there against. As seen in FIG. 2, housing 12 has a thickened portion 15A at its distal end which forms a narrowed channel 14A through which shaft 16 extends. This portion of housing 12 would provide more stability to shaft 16 as it is undergoing its reciprocating motion, and at the same time provide a point of lubrication for shaft 16 as it reciprocates. The shaft 16 is also maintained well centered, and prevents wobbling of the shaft during use. As illustrated in FIGS. 4 and 5, blade 50 would be of the type having a principal blade body 52, having a forward cutting or scraping edge 54, sharpened to a degree, and a tapered rear mounting portion 56. As seen, the rear mounting portion 56 would include a circular mounting ring 58, having a bore 59 therethrough, which would slidably accommodate a threaded bolt 57 therethrough, so that once blade 50 is in position, a nut 60 is secured to the bolt, and for safety, a cotter pin 62 is inserted into the end of bolt to secure the blade 50 in place. This secure and finished mounting is clearly seen in FIG. 5.

Returning now to the operation of the system, reference is made both to FIGS. 2 and 3. As explained earlier, the drive assembly 36 as seen in FIG. 1 is in position to receive a thrust of compressed air, from the gun 20, wherein the compressed air would drive a mechanical component within gun 20 and bear against the end of shaft 16 at point 41, as seen in FIG. 2. Of course in FIG. 2, the spring is fully extended in view of the fact that air has not yet been introduced to move shaft 16 forward. FIG. 3 illustrates the system following the introduction of the air to the assembly 36. As seen, the air has compressed the spring 42 and in doing so, has moved the drive shaft 16 to the forward position in what would result in a forward scraping motion by blade 50. Upon the interruption of the air flow to the assembly 36, the spring 42 would then return to its naturally extended state as seen in FIG. 2. Therefore, it would be through the continuous spurts of compressed air against the assembly 36, would result in the reciprocating movement of the shaft 16, and blade 50, which would result in the scraping movement of the blade.

As is clearly seen, through this means, the housing 12 and the handle members 18 and 30 remain stationary, held securely in place by the operator, with the shaft 16 and blade 50 continuously reciprocating as long as spurts of air is being introduced from the gun and forces the shaft 16 forward during the reciprocating motion.

Further, it is foreseen that the apparatus, depending on the size and the length of the job, may be somewhat heavy and cumbersome for use by an operator over a long period of time. Therefore, as stated earlier, there is provided a means by which an operator may be assisted in this process. As illustrated in FIG. 1, the second handle 30 mounted along the housing 12, which includes a grip portion 31 for the operator to manually grasp with his second hand. Although this helps to distribute the weight of the apparatus, this may not be sufficient.

Therefore, there is further provided a means to magnetically secure the apparatus to a metal surface, for example, the hull of a boat, as the scraping process is being undertaken. This means includes a mounting ring 70, mounted at a point along housing 12 to somewhat balance the apparatus. Mounting ring 70 is secured to a mounting plate 72 having a magnetic surface 74 which would magnetically adhere to the metal surface 28. The mounting plate 72 is mounted to ring 70 via a swivel means 73, which would allow 360 degree rotation of the apparatus within a given radius for scraping. Upon completion of scraping in a given area, the magnet 74 would be disengaged, and reengaged at a different point along the surface 28. It is further foreseen that the ring 70 could be slidingly engaged to the surface of housing 16, so that the housing may slide within the ring, and allow a greater area to be scraped without having to disengage magnet 74 from the surface 28.

FIG. 6 illustrates a slightly different drive assembly 36 as illustrated in the preferred embodiment. As seen, the apparatus would include all of the major components as previously discussed in the preferred embodiment. The principal change would be the operation of a spring 90 during the driving sequence. In the preferred embodiment, the spring 42 is normally in the extended position, and would compress due to the introduction of the compressed air. In the embodiment in FIG. 6, the spring 90 is in the normally retracted state, as illustrated, and when air is introduced, the spring extends outward in the direction of arrow 92, carrying along with it the drive shaft 16, during the forward movement. In essence, in this embodiment, the spring 90 is normally retracted, and is extended in the drive mode by the compressed air. It has been found that this type of arrangement, although workable, may place grated force on the spring 90 during operation, and the spring 90 would, through constant forced stretching, lose its elasticity sooner.

GLOSSARY OF TERMS scraper 10
elongated housing 12
distal end 13
housing body 15 thickened portion 15A
reduced bore 14A
drive shaft 16
mounting stop 17
first handle member 18
body portion 20
handgrip portion 22
line 24
support member 26
metal surface 28
second handle member 30
grip portion 31
strap 32
outer collar 34
drive assembly 36
drive component 38
flared portion 39
arrow 40
point 41
spring means 42
chamber 44
point 46
scraping blade 50
blade body 52
scraping edge 54
tapered mounting portion 56
mounting ring 58
bore 59
bolt 57
nut 60
cotter pin 62
mounting ring 70
mounting plate 72
magnetic surface 74
swivel means 73
spring 90

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A scraper apparatus, comprising:
a) a principal elongated housing;
b) a handle member integral to a first end of the housing;
c) blade means extending from the second end of the housing;
d) drive shaft means within the housing upon which the blade is mounted;
e) pneumatic power means for powering reciprocating movement of the drive shaft means to impart reciprocating movement of the scraping blade;
f) means interconnecting the power means and the reciprocating drive shaft to provide the reciprocating motion of the shaft when power is applied thereto; and
g) support means secured along the length of the housing for securing the housing to a surface to support the weight of the apparatus during use.

2. The apparatus in claim 1, further comprising a second handle member movable attached to the housing for allowing a user to graft the second handle along the length of the housing to balance the weight of the apparatus during use.

3. The apparatus in claim 1, wherein the means interconnecting the power means and the reciprocating drive shaft further comprises a spring member which is compressed by air introduced by the power means, and reciprocates to the expanded state when air is not introduced.

4. The apparatus of claim 1, wherein the elongated housing also serves as a means to protect the internal mechanism within the housing, and to protect the user should there be an internal malfunction.

5. The apparatus in claim 1, wherein the support member comprises a magnet positioned on a support rod connected to the housing for magnetically adhering a metal surface.

6. A scraper apparatus, comprising:
a) a principal elongated housing;
b) a handle member integral to a first end of the housing;
c) a blade means extending from the second end of the housing;
d) a drive shaft means within the housing upon which the blade is mounted;
e) pneumatic power means for powering reciprocating movement of the drive shaft means to impart reciprocating movement of the scraping blade;
f) spring means interconnecting the power means and the reciprocating drive shaft to provide the reciprocating motion of the shaft when power is applied thereto; and
g) a support member along the length of the housing to secure the housing to a surface so that the weight of the apparatus is supported by the support member.

7. The apparatus in claim 6, wherein the apparatus is powered by a pneumatic power source, or some other equivalent source.

8. The apparatus in claim 6, wherein the means interconnecting the power means and the reciprocating drive shaft further comprises a spring member which is compressed by air introduced by the power means, and reciprocates to the expanded state when air flow is interrupted.

9. The apparatus in claim 6, wherein the support member comprises a magnet positioned on a support rod connected to the housing for magnetically adhering a metal surface.

10. The apparatus in claim 6, wherein the spring member may expand against the flow of pressurized air and contract when the air flow is interrupted.

11. The apparatus in claim 8, further comprising a second movable handle member attached to the shaft portion for helping to balance the weight of the apparatus during use of the apparatus.

12. A scraper apparatus, comprising:
a) a principal elongated housing;
b) a handle member integrally attached to a first end of the housing;
c) removable blade means extending from the second end of the housing;
d) a drive shaft extending through the housing secured to a scraping blade at a first end and to a reciprocating drive assembly on its second end;
e) pneumatic power means for powering the reciprocating movement of the drive shaft to impart reciprocating movement to the scraping blade;
f) spring means interconnecting the power means and the drive shaft to provide the reciprocating motion of the drive shaft when power is applied thereto; and g) a support member along the length of the housing to magnetically secure the housing to a surface so that the weight of the apparatus is supported in part by the support member.

13. The apparatus in claim 12, wherein the apparatus is powered by a pneumatic power source.

14. The apparatus in claim 12, wherein the spring means is compressed by air introduced by the power means, and reciprocates to the expanded state when air flow is interrupted.

15. The apparatus in claim 12, wherein the support magnet connected to the housing for magnetically adhering the apparatus to a metal surface provides for 360 degree rotation of the apparatus relative to the surface.

16. The apparatus in claim 12, wherein the spring member may expand against the flow of pressurized air and contract when the air flow is interrupted.

17. The apparatus in claim 12, further comprising a shoulder strap secured at each end of the housing for use by the operator.

* * * * *